US008359811B2

(12) United States Patent
Müller

(10) Patent No.: US 8,359,811 B2
(45) Date of Patent: Jan. 29, 2013

(54) MOUNTING MEANS FOR MOUNTING NATURAL STONE, AND METHOD OF MOUNTING NATURAL STONE

(76) Inventor: Martin Müller, Steinhausen (CH)

( * ) Notice: Subject to any disclaimer, the term of this patent is extended or adjusted under 35 U.S.C. 154(b) by 59 days.

(21) Appl. No.: 12/936,049

(22) PCT Filed: Mar. 25, 2009

(86) PCT No.: PCT/EP2009/053516

§ 371 (c)(1),
(2), (4) Date: Nov. 16, 2010

(87) PCT Pub. No.: WO2009/121772

PCT Pub. Date: Oct. 8, 2009

(65) Prior Publication Data

US 2011/0047916 A1 Mar. 3, 2011

(30) Foreign Application Priority Data

Apr. 2, 2008 (CH) ..... 505/08

(51) Int. Cl.
*E04B 1/00* (2006.01)

(52) U.S. Cl. ..... 52/747.12; 52/510; 52/477; 52/489.1; 52/597; 52/598

(58) Field of Classification Search ..... 52/510, 52/511, 512, 489.1, 506.05, 506.08, 597, 52/598, 489.2, 483, 385, 745.09, 747.1, 235, 52/387, 391, 392, 562, 568, 605
See application file for complete search history.

(56) References Cited

U.S. PATENT DOCUMENTS 2,003,996 A * 6/1935 Finzer et al. ..... 52/482
4,553,366 A * 11/1985 Guerin ..... 52/506.08
4,856,245 A * 8/1989 Osawa ..... 52/386
4,890,433 A * 1/1990 Funaki ..... 52/386

(Continued)

FOREIGN PATENT DOCUMENTS

DE 4228338 A1 10/1993
EP 0328030 A 8/1989

(Continued)

OTHER PUBLICATIONS

International search report for PCT/EP2009/053516 dated May 29, 2009.

*Primary Examiner* — William Gilbert
*Assistant Examiner* — Gisele Ford
(74) *Attorney, Agent, or Firm* — McCormick, Paulding & Huber LLP

(57) ABSTRACT

Natural stone cladding (10) with a plurality of strips (18.1, 18.2) for surface-parallel mounting on a surface to be clad, with a number of natural stone elements (11.1, 11.2) and a number of support holders (30.1, 30.2) and counterholders (20.1, 20.2). Each natural stone element (11.1, 11.2) comprises a visible front side and a rear side with a first machine-made longitudinal recess and a second machine-made longitudinal recess. Pairs of support holders (30.1, 30.2) are fastened to adjacent strips (18.1, 18.2) and one natural stone element (11.1, 11.2) is seated by the first longitudinal recess on these two support holders (30.1, 30.2). One each of the two support holders (30.1, 30.2) is seated a respective counterholder (20.1, 20.2), and each of the two counterholders (20.1, 20.2) engages in the second longitudinal recess (15) in order to secure the natural stone element (11.1, 11.2).

14 Claims, 6 Drawing Sheets

U.S. PATENT DOCUMENTS

| | | | | | |
|---|---|---|---|---|---|
| 5,069,014 | A | * | 12/1991 | Kubbutat | 52/235 |
| 5,255,484 | A | * | 10/1993 | Karlsohn | 52/506.05 |
| 5,390,457 | A | * | 2/1995 | Sjolander | 52/387 |
| 5,673,529 | A | * | 10/1997 | Treister et al. | 52/511 |
| 6,421,974 | B1 | * | 7/2002 | Whitehouse et al. | 52/510 |
| 8,033,066 | B2 | * | 10/2011 | Griffiths | 52/235 |

FOREIGN PATENT DOCUMENTS

| | | | |
|---|---|---|---|
| EP | 0621382 | A2 | 10/1994 |
| WO | 9301418 | A1 | 1/1993 |

* cited by examiner

MOUNTING MEANS FOR MOUNTING NATURAL STONE, AND METHOD OF MOUNTING NATURAL STONE

CROSS REFERENCE TO RELATED APPLICATIONS

This application is entitled to the benefit of and incorporates by reference essential subject matter disclosed in International Patent Application No. PCT/EP2009/053516 filed on Mar. 25, 2009 and Swiss Patent Application No. 00505/08 filed Apr. 2, 2008.

FIELD OF THE INVENTION

The subject matter of the invention is mounting means for mounting natural stone elements and a respective method. It relates especially to façade engineering and respective natural stone claddings.

BACKGROUND OF THE INVENTION

Natural stone claddings are increasingly used which in addition to a special visual appeal also ensure a permanent and clean solution. The current trends go in the direction of smaller natural stone elements 11.1, 11.2, 11.3 which are arranged in the manner of belts, as is shown in FIG. 1A on the basis of a vertical house façade. These natural stone elements 11.1, 11.2, 11.3 are difficult to mount, which drives up costs for such claddings and can lead to the consequence that imprecise defects occur during mounting which may impair the visual effect.

Frequently, natural stone elements are mounted on a wall with so-called anchors. One hole needs to be drilled into the wall for each anchor, and each anchor needs to be fastened individually in these holes. The natural stone elements then typically have holes on the rear side which enable placing the natural stone elements on the anchors.

Other façade solutions work with glued natural stone elements. This kind of façade cladding is partly rejected because builders doubt the durability of such glued solutions under changing weather conditions.

It is therefore the object to develop a mounting apparatus or respective mounting means which are easier to handle and which, depending on the wishes of the builder or architect, allow offering elegant and durable claddings with natural stone elements.

It is a further object in accordance with the invention to offer a solution which is stable and durable, with the mounting of the natural stone elements being simpler than was the case with previous approaches.

SUMMARY OF THE INVENTION

In accordance with the invention, a mounting means for a natural stone element comprises a rack for mounting in a surface-parallel manner on the surface (40); and a supporting mount which comprises means for fastening to the rack. The supporting mount comprises at least one projection (32) which is configured to engage beneath the natural stone element in such a way that in the mounted state the natural stone element sits on said projection, and the supporting mount comprises an accommodating area which is configured to accommodate a portion of a counterholder. A counterholder has an insertion area which is arranged in a complementary manner in relation to the accommodating area that during mounting the insertion area can be slid onto or applied to the accommodating area of the supporting mount so that the counterholder sits on the supporting mount in the mounted state, and a second projection which is configured to fix the natural stone element on the rear side in the mounted state.

The invention in another aspect is a natural stone cladding (10), comprised by a plurality of strips for surface-parallel mounting on a surface to be lined, a number m of natural stone elements and a number n of support holders and counterholders, the number n being twice as large as the number m. Each natural stone element has a visible front side and a rear side comprising a first mechanically produced longitudinal recess and a second mechanically produced longitudinal recess. Two support holders each are fastened to adjacent strips and one natural stone element, each sitting with the first longitudinal recess on said two support holders. One counterholder each is placed on each of the two support holders, and each of the two counterholders engages in the second longitudinal recess in order to fix the natural stone element.

The invention in a further aspect is a method for mounting a natural stone cladding, characterized by the following steps:

- surface-parallel fastening of at least two strips at a mutual distance to a surface to be lined;
- fastening of the first supporting mount to a first one of the two strips;
- fastening of a second supporting mount to a second one of the two strips;
- insertion of an elongated natural stone element whose longitudinal expansion is larger than the distance, with a first mechanically produced longitudinal recess of the natural stone element being slid onto respective projections of the support holders during the insertion;
- mounting of a first counterholder on the first supporting mount, with a respective projection of the counterholder engaging in a second mechanically produced longitudinal recess of the natural stone element; and
- mounting of a second counterholder on the second supporting mount, with a respective projection of the counterholder engaging in the second mechanically produced longitudinal recess of the natural stone element.

Preferred embodiments are disclosed in the following specification.

BRIEF DESCRIPTION OF THE DRAWINGS

Further details and advantages of the invention will be described below by reference to embodiments and the drawings. Unless reference is made explicitly to a special drawing in the description below, the described features refer to all embodiments, wherein.

DESCRIPTION OF THE PREFERRED EMBODIMENTS

Figure 1A:
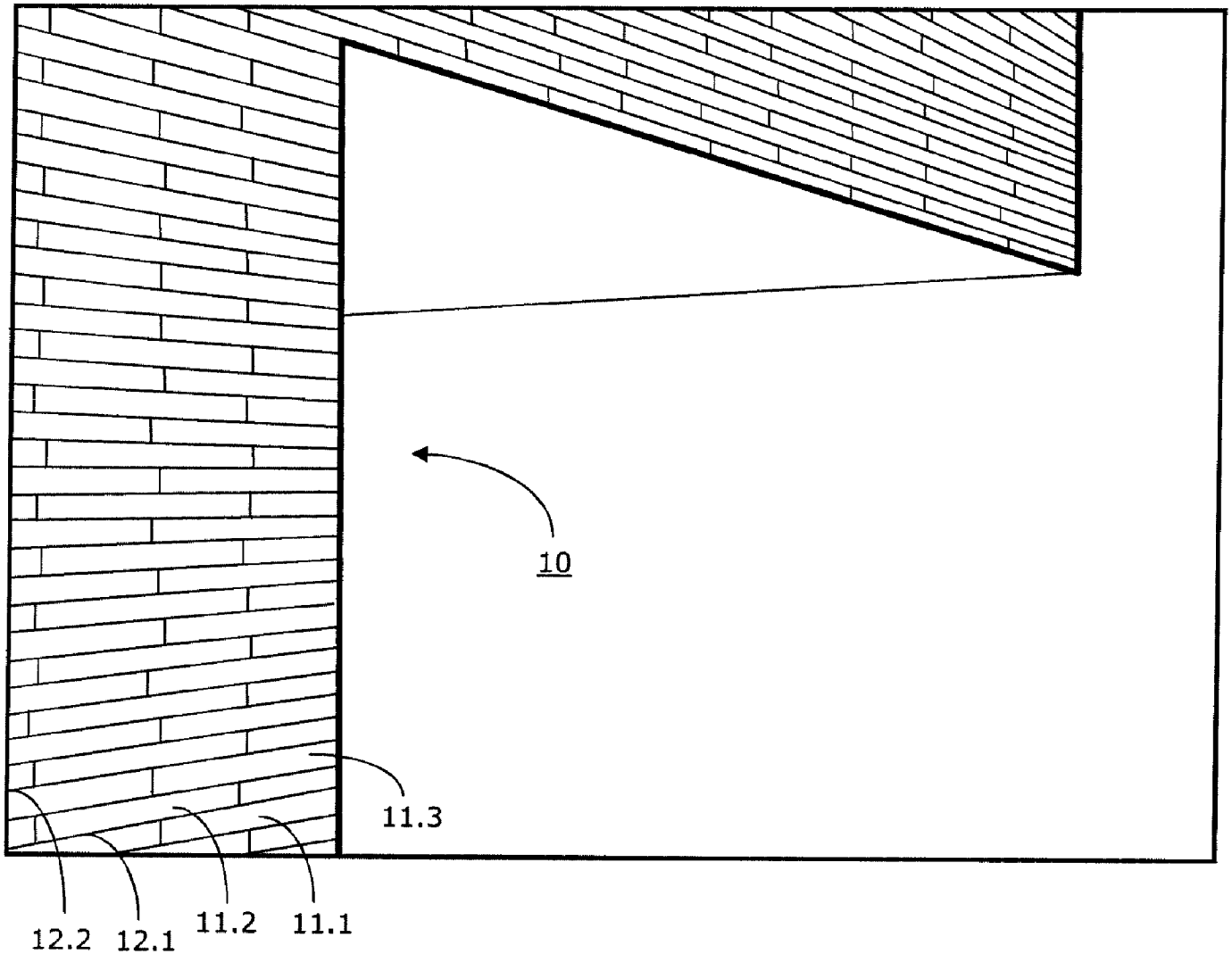
FIG. 1A shows a perspective view of a façade with a natural stone cladding of the vertical wall surfaces in accordance with the invention.

FIG. 1A shows a perspective view of a façade with a natural stone cladding 10 in accordance with the invention. It concerns the terrace area of a house. The walls are lined with elongated, rectangular blocks made of natural stone. Three of these so-called natural stone elements 11.1, 11.2, 11.3 and the respective joints 12.1, 12.2 are designated with reference numerals.

Figure 1B:
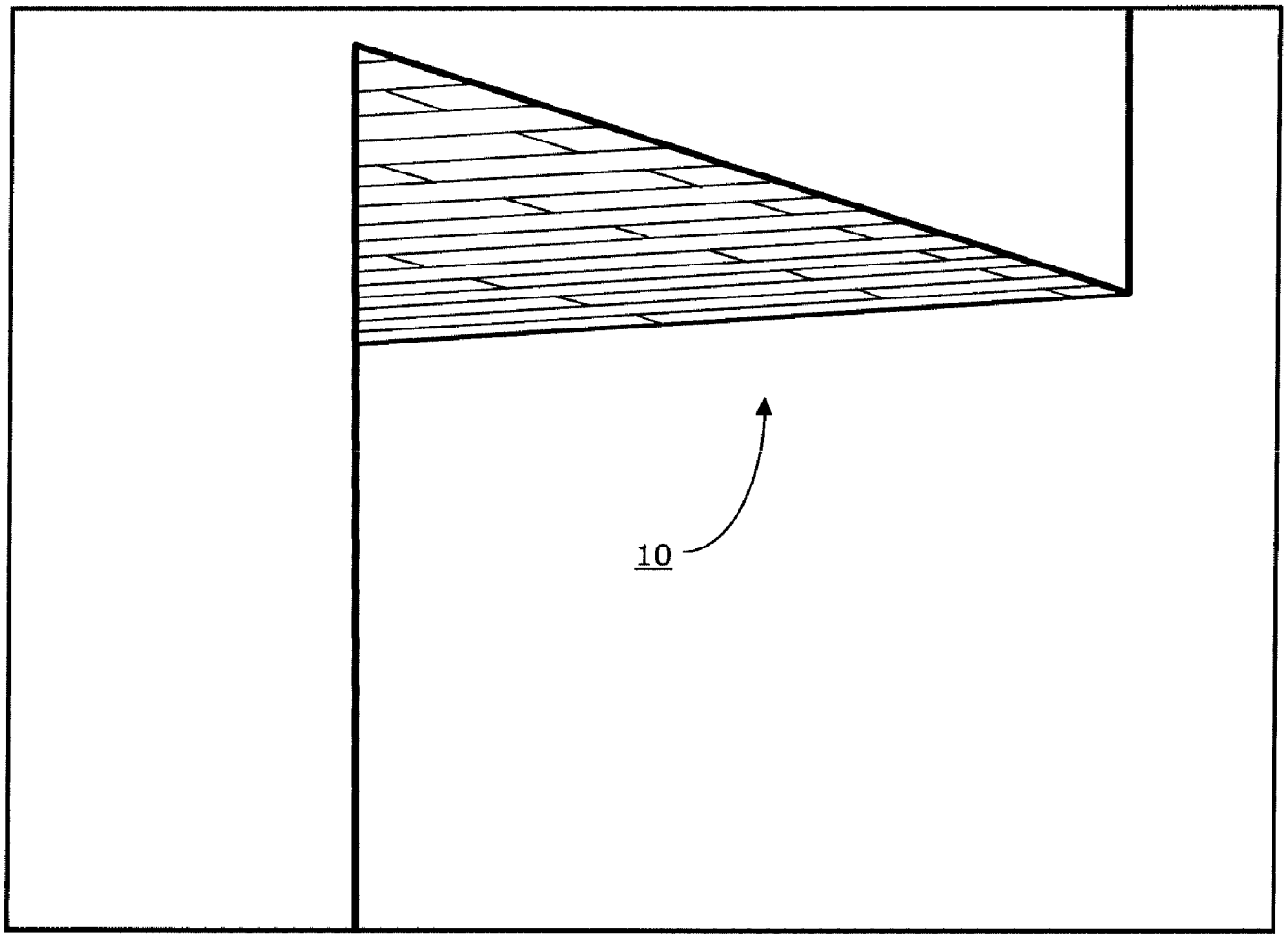
FIG. 1B shows a perspective bottom view of a façade with a natural stone cladding in accordance with invention.

It is indicated in FIG. 1B that also a wall seen from below can be provided with a natural stone cladding 10 in accordance with the invention.

Figure 2:
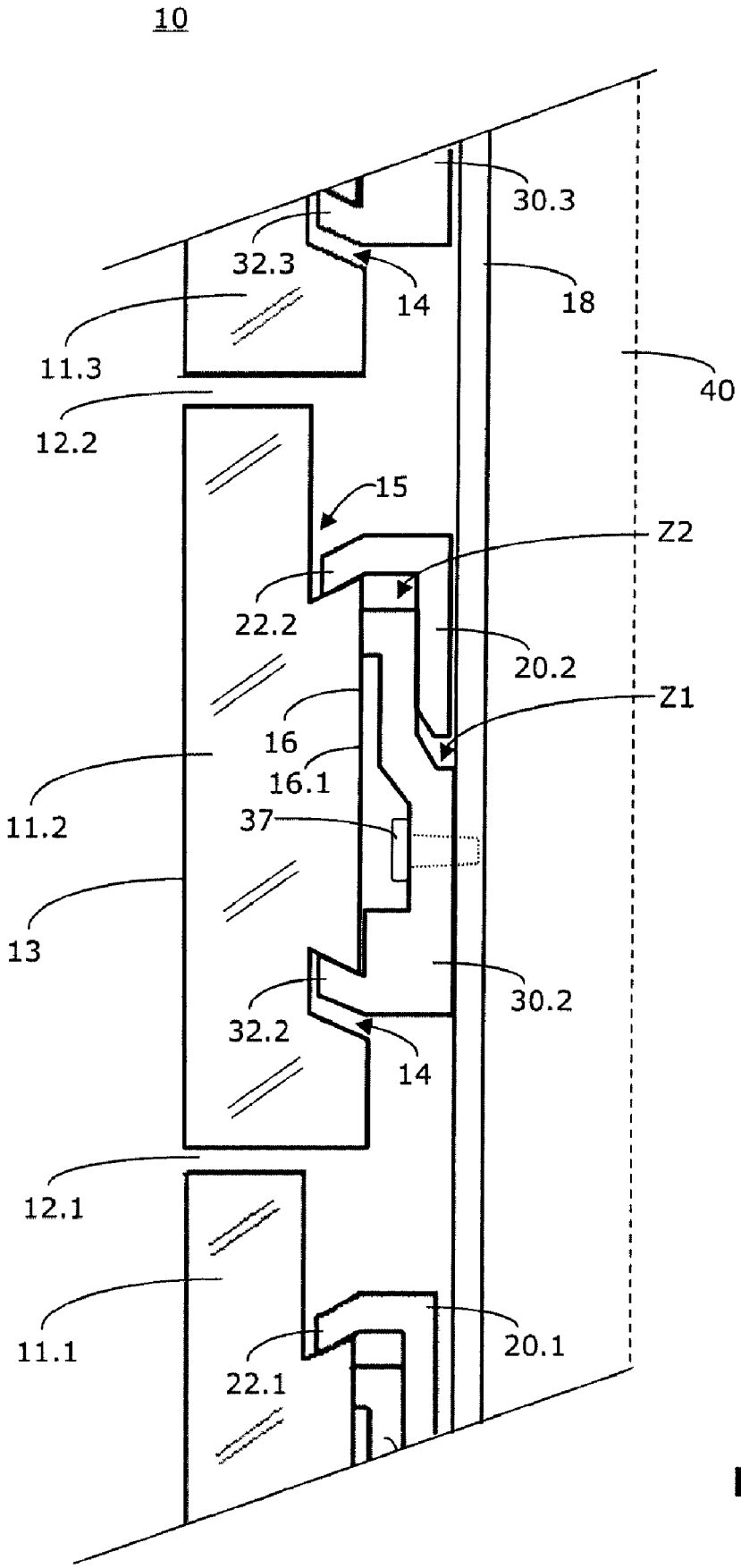
FIG. 2 shows a schematic sectional view of a natural stone cladding in accordance with the invention.

FIG. 2 shows a sectional view through the three natural stone elements 11.1, 11.2, 11.3 of FIG. 1A.

The general arrangement of the novel natural stone cladding 10 in accordance with the invention will be described below. The arrangement is described by reference to a vertical wall surface. The natural stone cladding 10 in accordance with the invention can also be used on other surfaces, as indicated in FIG. 1B. When the terms of "wall", "vertical", "horizontal", etc. are used, then such terms relate merely to the arrangement of a wall cladding. These terms shall be adapted accordingly for the lining of other surfaces.

Figure 7:
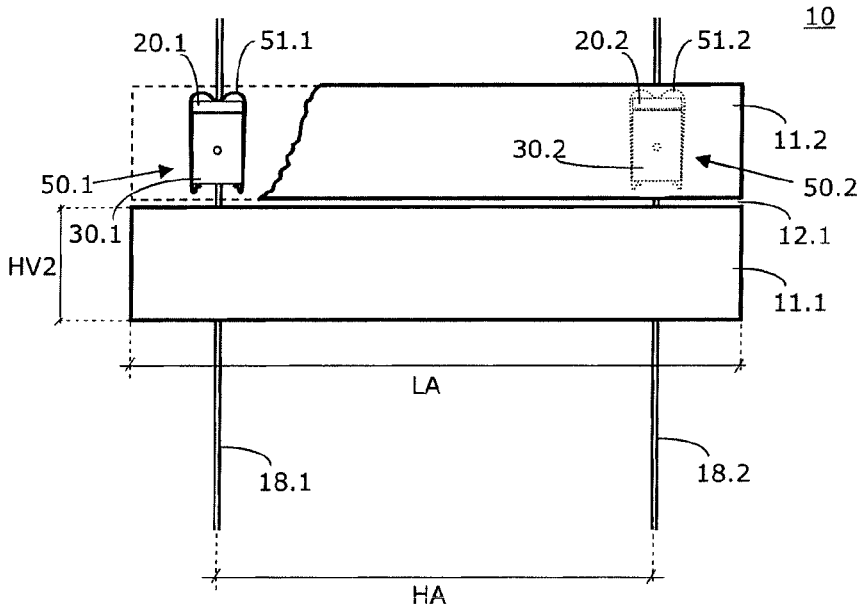
FIG. 7 shows a schematic front view of a natural stone cladding in accordance with the invention during mounting.

The natural stone cladding 10 comprises a plurality of strips (wall-mounting racks) 18 which are mounted parallel to a wall 40 to be lined. FIG. 2 shows such a wall-mounting rack 18 (two wall-mounting racks 18.1, 18.2 are shown in FIG. 7). The wall-mounting rack 18 sits on wall 40 in the illustrated example. The wall-mounting rack 18 can be fastened by means of dowels for example to the wall 40. Preferably, round or oblong holes (not shown in the drawings) are provided in the wall-mounting rack 18 which allow simple and rapid screwing or riveting of the other mounting means 50, as will be explained below in closer detail. The support holders 30 and/or the counterholders 20 can also be hooked or inserted into said wall-mounting rack 18.

A supporting mount 30 can be fastened at the desired height to such a wall-mounting rack 18. FIG. 2 shows that the supporting mount with the reference numeral 30.2 is fastened with a rivet or screw 37 to the wall-mounting rack 18. The rivet or screw 37 can be placed through a hole 35 (see FIG. 4A, 4B) which is provided in the supporting mount 30.3. Each supporting mount 30 comprises at least one first projection 32 which is configured to engage beneath the natural stone element 11 in such a way that the natural stone element 11 sits on this projection 32. Moreover, the supporting mount 30 comprises an accommodating area 36 which is arranged to accommodate a part 24 of a counterholder 20, as is indicated schematically in FIG. 5.

The counterholder 20 comprises an insertion area 24 which is arranged in a complementary manner to the accommodating area 36 or the placement area that during mounting the insertion area 24 can be slid onto the accommodating area 36 of the supporting mount 30. As a result, the counterholder 20 sits or is disposed in the mounted state on the supporting mount 30, as is shown in FIG. 2, where a counterholder 20.2 sits on a supporting mount 30.2.

The counterholder 20 comprises a second projection 22 which is arranged to fix the natural stone element 11 on the rear side in the mounted state, as is shown in FIG. 2. FIG. 2 shows the respective projections 22.1 of a bottom counterholder 20.1 and 22.2 of a middle counterholder 20.2.

Each natural stone element 11 comprises a visible front side 13 and a rear side 16 with a first mechanically produced longitudinal recess 14 (which is also designated here as a horizontal recess) and a second mechanically produced longitudinal recess 15 (which is also designated here as a horizontal recess). The first and second longitudinal recesses 14, 15 define between them a protruding dovetail portion 16.1.

Figure 8A:
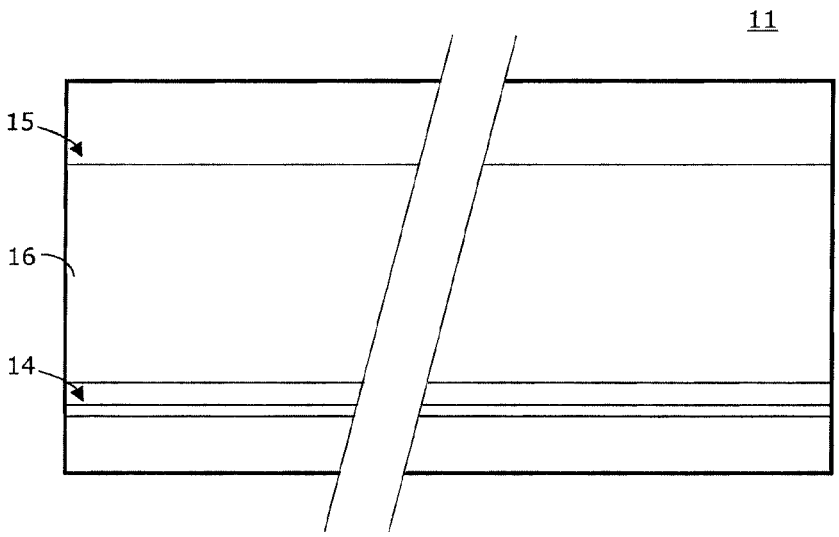
FIG. 8A shows a schematic front view of a natural stone element of a natural stone cladding in accordance with the invention.
Figure 8B:
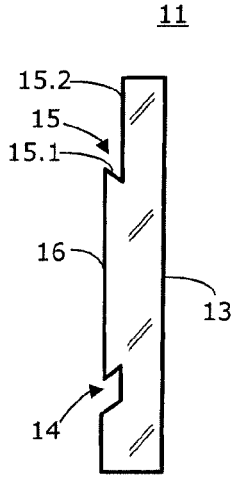
FIG. 8B shows a schematic sectional view of a natural stone element of a natural stone cladding in accordance with the invention.
Figure 8C:
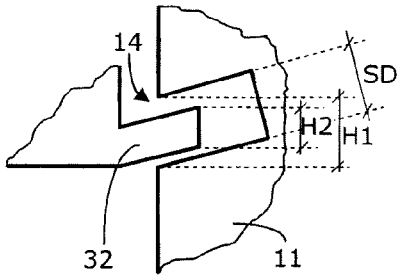
FIG. 8C shows a schematic enlargement of a section of a natural stone element of a natural stone cladding in accordance with the invention.

Natural stone elements 11 which are processed in this manner do not yet exist. A special machine tool is used for its production/machining which produces or machines the longitudinal recesses 14 and 15 by circular saw blades which are adjusted in different ways. The first mechanically produced longitudinal recess 14 is preferably produced by a circular saw blade which has a thickness SD, as is shown in FIG. 8C on the basis of an enlargement of a sectional view. This circular saw blade dips into the natural stone element 11 up to the desired depth from behind and thus produces the recess 14 over the entire (horizontal) length LA.

Notice must be taken at this point that the length LA of the natural stone elements can vary. FIG. 1A shows an example in which each natural stone element 14 has a slightly different length.

A further circular saw blade dips with another inclined position from behind into the natural stone element 11 in order to produce a surface 15.1 of the second longitudinal recess 15. The second surface 15.2 of the longitudinal recess 15 is produced by a circular saw blade which lies parallel to the main plane of the natural stone element 11.

Figure 3A:
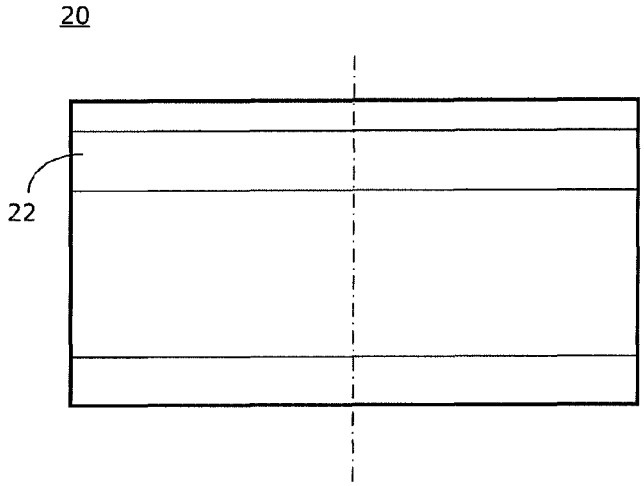
FIG. 3A shows a schematic front view of a first counterholder of a natural stone cladding in accordance with the invention.
Figure 3B:
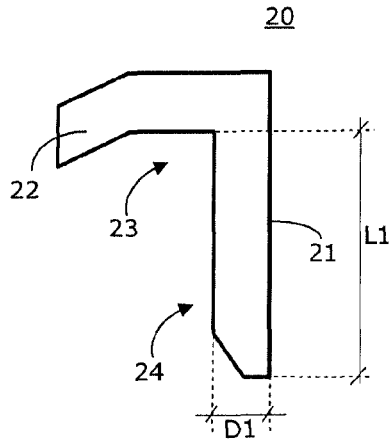
FIG. 3B shows a schematic side view of a first counterholder of a natural stone cladding in accordance with the invention.

Details of the first counterholder 20 are shown in FIGS. 3A and 3B. This counterholder 20 has the approximate shape of an "L" which is upside down. FIG. 3 shows in a side view that the counterholder 20 has a leg arranged as a projection 22 (which is designated here as the second projection) which is slightly downwardly inclined in the manner of a nose. As a result of the downwardly facing inclination, a clamp-like angular area 23 is obtained which is slightly set back. The second leg forms an insertion area 24 with a rear side 21 or a rear surface. The thickness D1 of the second leg is chosen in such a way that the insertion area 24 of this leg fits behind the supporting mount 30 when the supporting mount 30 is fastened to the wall-mounting rack 18. The length L1 of the insertion area 24 is preferably chosen in such a way that it is slightly shorter than the length L2 of the accommodating area 36. It is thus ensured that the counterholder 20 does not sit entirely on the supporting mount 30 with its angular area 23. Respective intermediate spaces preferably remain, which are designated in FIG. 2 with reference numerals Z1 and Z2.

Figure 5:
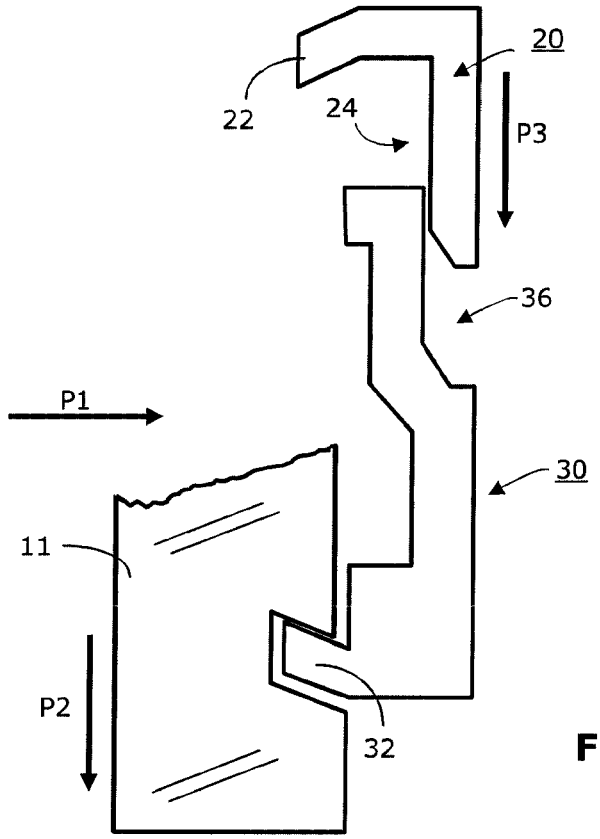
FIG. 5 shows a schematic sectional view of a natural stone cladding in accordance with the invention during mounting.

It is schematically indicated in FIG. 5 that the first longitudinal recess 14 of the natural stone element 11 can be slid onto the projection 32 by a movement P1. As a result of the weight P2, the natural stone element 11 will then be pulled downwardly (in the case of a natural stone cladding of a vertical wall) and is thus carried by the supporting mount or support holder 30. In order to ensure that the natural stone element 11 is secured or fixed, the counterholder 20 is inserted from above into the accommodating region 36, as is indicated by the arrow P3. Since the projection 22 of this counterholder engages from above and behind into the longitudinal recess 15 of the natural stone element 11, the protruding dovetail portion 16.1 is gripped between the support holder 30 and the counterholder 20, such that the natural stone element 11 is fixed and can no longer be removed from the wall 40.

Figure 6:
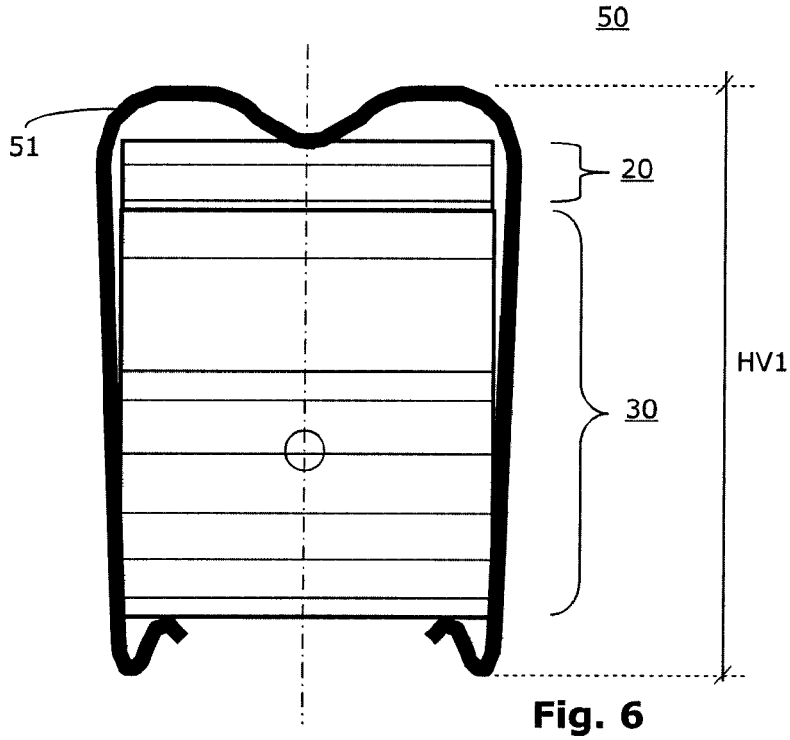
FIG. 6 shows a schematic front view of a mounting means in accordance with the invention.

In a preferred embodiment which is indicated in FIG. 6, the mounting means 50 can comprise a securing element in the form of a clasp-like spring 51 for example. This securing element 51 can be inserted or slid onto the supporting mount 30 with the counterholder 20 in order to prevent that the counterholder 20 can be removed. In addition to this pure securing function, the securing element 51 preferably has the task of predetermining a precisely defined spring force. This spring force acts between the supporting mount 30 and the counterholder 20. As a result of the spring force, the projection 22 of the counterholder is pulled into the longitudinal recess 15 and tightly clamps the natural stone element 11.

In an especially preferred embodiment of the invention, two securing elements 51.1 and 51.2 are used for each natural stone element 11, which securing elements have differently large spring forces. The securing element 51.1 can have a larger spring force for example in order to tightly clamp the natural stone element 11 with the supporting mount 30.1 and the counterholder 20.1 at a predetermined position. The securing element 50.2 on the other hand has a slightly lower spring force, so that the natural stone element 11 can slightly slip in the region of the supporting mount 30.2 and the counterholder 20.2. Fluctuations caused by temperature can be compensated with this kind of embodiment.

A similar effect can be achieved in that identical securing elements 51 are used at all points, with those surfaces of a pair consisting of supporting mount 30.1 and counterholder 20.1 being coated with a rough material (e.g. sand or corundum) offering good grip which come into contact with the natural stone element 11. The respective surfaces of the other pair are not coated. It is also possible to provide the respective surfaces with a sliding coating, whereas the surfaces of the other remain uncoated. These two approaches can also be combined.

Figure 4A:
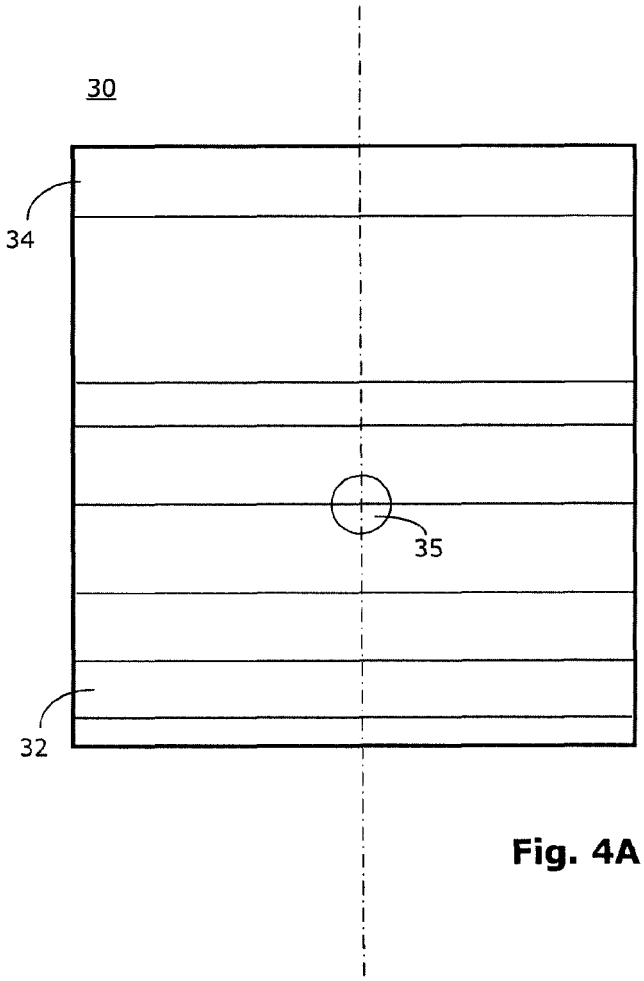
FIG. 4A shows a schematic front view of a first supporting mount of a natural stone cladding in accordance with the invention.
Figure 4B:
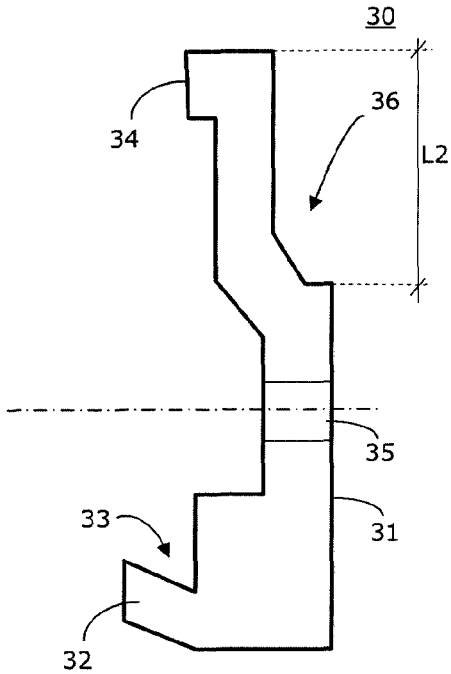
FIG. 4B shows a schematic sectional view of a first supporting mount of a natural stone cladding in accordance with the invention.

FIGS. 4A and 4B show a preferred embodiment of a supporting mount 30. The sectional view shows that the supporting mount 30 substantially comprises two areas which fulfill the two different functions of the supporting mount 30. Firstly, the supporting mount 30 is used for carrying/fixing the natural stone element 11. In order to enable this, the supporting mount 30 comprises a projection 32 (which is also designated here as the first projection) which defines a hook-like angular region 33 (in the form of an upwardly facing nose). Furthermore, the supporting mount 30 comprises an accommodating area 36 for accommodating the counterholder 20. Preferably, this accommodating area 36 is arranged in a complementary manner to the insertion area 24 of the counterholder 20, so that the counterholder 20 can be slid or inserted on or behind the supporting mount 30.

In order to enable good contact on the wall-mounting rack 18, the supporting mount 30 preferably has a planar rear side 31.

Preferably, the supporting mount 30 comprises a nose 34 with a stop face, on which the natural stone element 11 can rest with its rear side 16. This nose 34 is optional. A respective supporting mount 30 is shown in FIG. 4B.

Both the supporting mount 30 and also the counterholder 20 are preferably made of respectively shaped metal or plastic sections which are cut to size in the respective lengths. These counterholders 20, 30 can thus be produced in a simple and precise way in large piece numbers. Aluminum sections or sections made of nickel-plated or hot-dip galvanized steel have proven to be particularly useful.

Preferably, each pair consisting of a supporting mount 30 and a counterholder 20 together with the applied or inserted securing element 51 has a total height HV1 which is slightly smaller than the height HV2 of the natural stone element 11 (see FIGS. 6 and 7). It is thus ensured that even in the case of a natural stone cladding 10 with open intermediate spaces 12.1, 12.2 (which means without joint material) the mounting means 50 are not visible from the outside, or only hardly so.

An exemplary mounting process will be explained below. The wall-mounting brackets 18.1, 18.2 are mounted at a defined distance HA parallel with respect to each other on a wall 40 or surface to be lined (it is also possible to line other surfaces such as horizontal or oblique surfaces in this manner), as indicated in FIG. 7. The support holders 30.1 and 30.2 are then fastened at the desired height. This can occur for example by means of rivets or screws 37. A natural stone element 11.2 is then slid or inserted into the projections 32 of the support holders 30.1, 30.2 (movement P1 in FIG. 5). As a result of the weight P2, the natural stone element 11.1 is pulled downwardly and is held by the two support holders 30.1, 30.2. The counterholders 20.1, 20.2 are slid or inserted into the respective support holders 30.1, 30.2 from above. The natural stone element 11.2 is thus fixed by this step. Depending on the embodiment, the optional securing elements 51.1, 51.2 can be inserted or slid on in order to apply the desired spring force on the pairs of support holders/counterholders 30.1, 20.1 and 30.2, 20.2, or in order to secure the holders of the pairs against one another.

At least two support holders 30 and two counterholders 20 are required for each natural stone element 11. In the case of very long natural stone elements 11, it is also possible to use several such pairs. It needs to be ensured however that tensions do not occur in the stone 11.

Depending on statutory regulations, the natural stone elements 11 must be secured in such a way that they cannot break up and then fall down. In order to ensure this, respective means can be provided on the rear side 16. It is either possible to insert or glue a steel cable into a further (e.g. horizontally extending) third recess or the rear side 16 can be covered with a net or band.

A weatherproof rubber ring can also be used as securing element 51 which encompasses the supporting mount 30 and counterholder 20.

While the present invention has been illustrated and described with respect to a particular embodiment thereof, it should be appreciated by those of ordinary skill in the art that various modifications to this invention may be made without departing from the spirit and scope of the present.

| | |
|---|---|
| Façade/surface | 10 |
| Natural stone element | 11 |
| First natural stone element | 11.1 |
| Second natural stone element | 11.2 |
| Third natural stone element | 11.3 |
| First intermediate space | 12.1 |
| Second intermediate space | 12.2 |

-continued

| | |
|---|---|
| Front side | 13 |
| First longitudinal recess | 14 |
| Second longitudinal recess | 15 |
| Rear surface | 16 |
| Wall-mounting rack or rack | 18 |
| First wall-mounting rack or rack | 18.1 |
| Second wall-mounting rack or rack | 18.2 |
| Counterholder | 20 |
| First counterholder | 20.1 |
| Second counterholder | 20.2 |
| Rear surface | 21 |
| Second projection | 22 |
| Angular area | 23 |
| Insertion area | 24 |
| Counter-teeth | 25 |
| Supporting mount | 30 |
| Second supporting mount | 30.2 |
| Third supporting mount | 30.3 |
| Rear surface | 31 |
| First projection | 32 |
| Angular area | 33 |
| Nose with stop face (optional) | 34 |
| Hole (means for fastening) (optional) | 35 |
| Accommodating area | 36 |
| Screw or rivet (means for fastening) | 37 |
| Teeth | 38 |
| Wall | 40 |
| Mounting means | 50 |
| Securing element | 51 |
| First securing element | 51.1 |
| Second securing element | 51.2 |
| Horizontal distance or distance | HA |
| Vertical height of the mounting means 50 | HV1 |
| Vertical Height of the natural stone element 11 | HV2 |
| Horizontal extension (length) of the natural stone element 11 | LA |
| Mounting movement | P1 |
| Weight | P2 |
| Mounting movement | P3 |

What is claimed is:

1. A method for mounting a natural stone cladding, characterized by the following steps:

fastening of at least two strips to a surface to be clad, said strips being parallel and spaced apart by a first distance;

fastening of a first supporting mount to a first one of the two strips;

fastening of a second supporting mount to a second one of the two strips;

insertion of an elongated natural stone element whose longitudinal extent is larger than the first distance, with a first mechanically produced longitudinal recess of the natural stone element being slid onto respective projections of the supporting mounts during the insertion;

mounting of a first counterholder on the first supporting mount, with a respective projection of the counterholder engaging in a second mechanically produced longitudinal recess of the natural stone element;

mounting of a second counterholder on the second supporting mount, with a respective projection of the counterholder engaging in the second mechanically produced longitudinal recess of the natural stone element.

2. A method according to claim 1, with a securing element being placed or slid onto each supporting mount for fastening the counterholder mounted thereto.

3. An apparatus for mounting a natural stone element in front of a surface, comprising a rack for mounting in a surface-parallel manner on the surface;

a supporting mount which comprises means for fastening to the rack, with at least one projection which is configured to engage beneath the natural stone element in such a way that in the mounted state a dovetail protrusion of the natural stone element sits on said projection, and with an accommodating area which is configured to accommodate a portion of a counterholder;

a counterholder with an insertion area which is arranged in a complementary manner in relation to the accommodating area of the supporting mount that the counterholder sits on the supporting mount in the mounted state, and with a second projection which is configured to grip the dovetail protrusion of the natural stone element, opposite the at least one projection of the supporting mount, in the mounted state.

4. An apparatus according to claim 3, characterized in that they additionally comprise a securing element which connects the counterholder and the supporting mount with each other after the placement of the counterholder on the supporting mount.

5. An apparatus according to claim 3, characterized in that the securing element concerns a spring element which connects the counterholder and the supporting mount with one another with a defined spring force.

6. An apparatus according to claim 3, characterized in that two mounting means each consisting of one supporting mount, one counterholder and a rack are used for each natural stone element, with the strips concerning such which extend parallel with respect to each other along the surface and which have a distance from each other which is smaller than the linear extension of the natural stone element.

7. An apparatus according to claim 3, characterized in that a first mounting means consisting of one supporting mount, one counterholder and one rack each and a second mounting means consisting of one supporting mount, one counterholder and one rack each are used for each natural stone element, with the first mounting means comprising a first securing element and the second mounting means comprising a second securing element, with the first securing element applying a smaller spring force than the second securing element.

8. A natural stone cladding, comprising:

at least two strips for mounting on a surface to be clad, said strips being mounted in parallel and spaced apart by a first distance;

a number (m) of natural stone elements each having a visible front side and having a rear side with a first longitudinal recess opening toward a first edge of the natural stone element and a second longitudinal recess opening away from the first longitudinal recess toward an opposing second edge of the natural stone element, the two longitudinal recesses together defining a dovetail protrusion at the rear side;

a first group and a second group of support holders, each said group of support holders including the number (m) of support holders mounted respectively to a first strip of the at least two strips or to an adjacent second strip of the at least two strips; and first and second groups of counterholders corresponding to the first and second groups of support holders, with each natural stone element placed sitting with its first longitudinal recess on one of the first group of support holders and on an adjacent one of the second group of support holders, and with one of the first group of counterholders being placed on the one of the first group of support holders, one of the second group of counterholders being placed on the one of the second group of support holders, and each of the two counterholders engaging in the second longitudinal recess of the natural stone element in order to fix the natural stone element by gripping between the support holders and the counterholders the dovetail protrusion of the natural stone element.

9. A natural stone cladding according to claim 8, characterized in that each of the support holders comprises at least one first projection which is configured to engage beneath the natural stone element in such a way that in the mounted state the natural stone element sits with its first longitudinal recess on said projection, and comprises an accommodating area which is configured to accommodate a portion of the counterholder.

10. A natural stone cladding according to claim 9, characterized in that each of the counterholders comprises an insertion area which is configured such that during mounting the insertion area can be slid onto the accommodating area of the support holder, so that the counterholder sits on the support holder in the mounted state, and comprises a second projection which is configured to fix the natural stone element on the rear side by engagement in the second longitudinal recess in the mounted state.

11. A natural stone cladding according to claim 10, further comprising one securing element for each counterholder, which securing element connects the counterholder to the support holder after the placement of the counterholder on the support holder.

12. A natural stone cladding according to claim 11, characterized in that the securing element consists of a spring element which connects the counterholder and the support holder with each other with a defined spring force.

13. A natural stone cladding according to claim 9, wherein the accommodating area of each supporting mount extends generally oblique to the at least one projection.

14. A natural stone cladding according to claim 10, wherein the insertion area of each counterholder extends generally oblique to the second projection.

* * * * *